US006907820B2

(12) United States Patent
Jin et al.

(10) Patent No.: US 6,907,820 B2
(45) Date of Patent: Jun. 21, 2005

(54) PRESS FOR ASSEMBLING STRUCTURES

(75) Inventors: Kathy LiuHui Jin, Chesterfield, MO (US); Glenn E. McNeelege, St. Peters, MO (US)

(73) Assignee: MiTek Holdings, Inc., Wilmington, DE (US)

( * ) Notice: Subject to any disclaimer, the term of this patent is extended or adjusted under 35 U.S.C. 154(b) by 116 days.

(21) Appl. No.: 10/393,242

(22) Filed: Mar. 20, 2003

(65) Prior Publication Data

US 2004/0181936 A1 Sep. 23, 2004

(51) Int. Cl.[7] ..... B30B 15/04; B25C 7/00

(52) U.S. Cl. ..... 100/51; 100/231; 100/269.17; 100/913; 227/152; 269/910

(58) Field of Search ..... 100/50, 51, 52, 100/226, 231, 269.17, 913; 72/455; 29/432, 798; 269/910; 227/152

(56) References Cited

U.S. PATENT DOCUMENTS

| | | | | | |
|---|---|---|---|---|---|
| 1,088,002 | A | * | 2/1914 | White et al. | 60/431 |
| 2,552,304 | A | | 5/1951 | Arter | |
| 3,068,484 | A | | 12/1962 | Moehlenpah et al. | |
| 3,069,684 | A | | 12/1962 | Moehlenpah et al. | |
| 3,207,406 | A | | 9/1965 | Bowman | |
| 3,315,595 | A | | 4/1967 | Moehlenpah et al. | |
| 3,388,657 | A | | 6/1968 | Jureit | |
| 3,390,627 | A | | 7/1968 | Levkovitz | |
| 3,487,430 | A | | 12/1969 | Schmitt | |
| 3,530,790 | A | | 9/1970 | Post | |
| 3,605,608 | A | | 9/1971 | Dagley | |
| 3,728,958 | A | * | 4/1973 | Moehlenpah et al. | 100/100 |
| 3,824,919 | A | | 7/1974 | Moehlenpah | |
| 3,866,530 | A | | 2/1975 | Moehlenpah | |
| 3,896,717 | A | | 7/1975 | Schmitt | |
| 3,978,783 | A | | 9/1976 | Moehlenpah | |
| 4,174,061 | A | | 11/1979 | McDonald | |
| 4,567,821 | A | | 2/1986 | McDonald | |
| 4,627,564 | A | | 12/1986 | Bowser | |
| 4,756,072 | A | * | 7/1988 | Falzoni | 29/560 |
| 5,315,856 | A | * | 5/1994 | Mackey | 72/389.6 |
| 5,343,728 | A | * | 9/1994 | Chubb et al. | 72/319 |
| 6,055,902 | A | * | 5/2000 | Harrop et al. | 100/52 |
| 2002/0195004 | A1 | | 12/2002 | Mead | |

* cited by examiner

*Primary Examiner*—Derris H. Banks
*Assistant Examiner*—Jimmy Nguyen
(74) *Attorney, Agent, or Firm*—Senniger Powers

(57) ABSTRACT

A press apparatus for pressing connector plates into opposing surfaces of structural members which are to be secured together to form a structure such as a roof truss. The apparatus includes a frame particularly constructed to reduce stress concentrations and failure. Forces applied to the frame are transmitted in a loadpath which is smooth and free from discontinuity to inhibit concentration of stress and thereby strengthen the frame against fatigue damage. The frame includes ribs spanning and connecting an inner rim and outer rim for strengthening the frame. A powered actuator has a body which is removably attachable to the frame, and a timer control operates the press to make sure the connector plates are fully embedded.

43 Claims, 8 Drawing Sheets

PRESS FOR ASSEMBLING STRUCTURES

BACKGROUND OF THE INVENTION

This invention relates generally to the assembly of structures, and in particular to a press for manufacturing trusses which provides several advantageous features.

Pre-manufactured structural frameworks, such as trusses, are widely used in the construction industry for forming a roof, wall panel, floor, or other building component. The truss is assembled to the correct specifications at a factory and then shipped to a construction site. Each truss includes a collection of structural members made of wood, plastic, or metal which are held together by fasteners, such as nailing or connector plates. Efficient assembly of the truss is facilitated by a press apparatus which drives the connector plates into assembled precut structural members where they intersect or abut each other.

In one widely used type of system, a press is suspended from an overhead carriage for movement between several splice pedestals (or stands) supporting the structural members in assembled position. Each of the pedestals includes a holder for holding a lower connector plate at a position below the structural members and bridging lower surfaces of the structural members at their intersection or abutment. An upper connector plate is placed over the joint so that it bridges upper surfaces of the structural members. The press has a C-shaped frame which carries upper and lower platens adapted to be positioned above and below the respective upper and lower connector plates. Actuation of a hydraulic powered cylinder causes the upper platen to move downwardly toward the lower platen and press the joint so that the connector plates are driven into the structural members thereby connecting the structural members.

There has been growing demand for larger, heavier trusses using larger sizes of connector plates, such as 8×8 inches and 10×12 inches, which require a larger capacity press, e.g., on the order of about 37.5 to 50 tons instead of 25 tons. Unfortunately, existing presses have a number of drawbacks which degrade their effectiveness in applying such a large force without substantial increases in size and weight of the frame.

Frames of the prior art are prone to fatigue damage. Typically, a frame has two major structural parts including an inner peripheral rim defining the inside edge of the C-shape and an outer peripheral rim defining the outer edge. For lower cost manufacturing (e.g., by forging of steel), the frame has a profile which is not a substantially rounded "C", but rather a generally rectangular "C". Consequently, the frame has two substantially 90° turns at corners of the C-shape, separating the generally horizontal and vertical portions of the "C". During operation, the frame is exposed to a reaction force urging apart the upper and lower platens. Unfortunately, stress concentrations arise at each turn which produce a local stress greater than a nominal stress. Consequently, the frame tends to develop fatigue cracks and fail sooner than should be expected for its size and loading. Aggravating this problem is that the majority of the load is transmitted through the inner peripheral rim, which consequently exhibits the earliest fatigue damage. The inner and outer rims are divided such that the loads carried by each are separate, without the added stability or efficiency if the load was shared in a structural framework.

Systems of the prior art are not designed for rapid maintenance and repair. The hydraulic cylinder for driving the upper platen includes a tubular body holding a reciprocally movable piston connected to a movable rod. That body is typically welded to the frame. Consequently, the body carries load and is subject to fatigue damage, particularly along the weld. Replacement of the cylinder is difficult and requires substantial down time. Moreover, maintenance work on the cylinder or its replacement with a new or differently sized cylinder and piston is a major repair effort. There is no flexibility in quickly substituting differently sized cylinders for carrying different loads tailored to the truss. The cylinder and its tubular body are not "off the shelf" items.

The upper platen is subject to failure when used with high loadings. Periodically, the platen inadvertently presses a non-flat object, such as due to operator error or due to an incorrectly positioned stop on the pedestal. That exposes a portion of the platen to an even greater load which frequently leads to permanent deflection or failure.

Operationally, presses of the prior art are inefficient. An operator controls a switch to activate the hydraulic cylinder and apply force through the cylinder to the joint. The operator makes a visual judgment of whether the connector plates are completely embedded into the structural members, and releases the switch so that the platens may separate. Often, the operator misjudges that time and must conduct one or more repetitive cycles of force application. Further, the press may be limited in magnitude of force due to the aforementioned structural drawbacks and cylinder size and requires several cycles to embed larger connector plates. Thus, substantial delays may occur in the construction of a roof truss.

SUMMARY OF THE INVENTION

Among the several objects and features of the present invention may be noted the provision of an apparatus for pressing connector plates into structural members which inhibits fatigue damage; the provision of such an apparatus which distributes load effectively; the provision of such an apparatus which is easy to maintain and repair; the provision of such an apparatus which applies greater force without a corresponding increase in mass of the frame; and the provision of such an apparatus which is operationally efficient.

In general, a press according to the present invention is for use in pressing connector plates into opposing surfaces of structural members which are to be secured together at one or more joints to form a structure. The press comprises first and second platens sized and shaped for engaging connector plates to press the connector plates into the structural members. A frame includes a first mounting portion mounting the first platen, a second mounting portion mounting the second platen and a third portion interconnecting the first and second mounting portions. The frame positions the first and second platens in generally opposed relation for relative movement toward each other to press connector plates into the structural members and away from each other to clear the structural members and connector plates. An actuator is mounted on the frame for applying a force to at least one of the first and second platens to forcibly move the platen. The third portion of the frame is free of straight sections thereby to inhibit the concentration of stress in one location of the frame in operation of the press.

In another aspect, a press of the present invention is for use in pressing connector plates into opposing surfaces of structural members which are to be secured together at one or more joints to form a structure. The press comprises first and second platens sized and shaped for engaging connector plates to press the connector plates into the structural members. A frame mounts the first and second platens in generally opposed relation for relative movement toward each other to press connector plates into the structural members and away from each other to clear the structural members and connector plates. An actuator is mounted on the frame for applying a force to at least one of the first and second platens to forcibly move the platen. The frame includes a peripheral inner rim, a peripheral outer rim and ribbing spanning and connecting the inner rim to the outer rim.

In yet another aspect, a press of the present invention is for use in pressing connector plates into opposing surfaces of structural members which are to be secured together at one or more joints to form a structure. The press comprises first and second platens sized and shaped for engaging connector plates to press the connector plates into the structural members. A frame mounts the first and second platens in generally opposed relation for relative movement toward each other to press connector plates into the structural members and away from each other to clear the structural members and connector plates. An actuator is mounted on the frame for applying a force to at least one of the first and second platens to forcibly move the platen. A timer control is adapted for automatically holding the actuator at a preselected force for a preselected period of time and then to move at least one of the first and second platens away from the other platen to release the force.

In still a further aspect, a press of the present invention is for use in pressing connector plates into opposing surfaces of structural members which are to be secured together at one or more joints to form a structure. The press comprises first and second platens arranged for placement proximate the opposing surfaces of the structural members and relatively movable toward and away from one another. The platens are configured for pressing the connector plates into the structural members. A frame mounts the platens, the frame having a generally C-shaped contour with an inner peripheral load carrying surface and an outer peripheral load carrying surface. The inner peripheral load carrying surface of the frame has a shape which defines a segment of a circle such that forces applied to the frame while the platens are pressing the connector plates are transmitted in a loadpath through the inner peripheral load carrying surface which is smooth and substantially free from discontinuity to inhibit concentration of stress at any position along the inner peripheral load carrying surface and thereby strengthen the frame against fatigue damage.

Other objects and features of the present invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION OF THE PREFERRED EMBODIMENT

Figure 1:
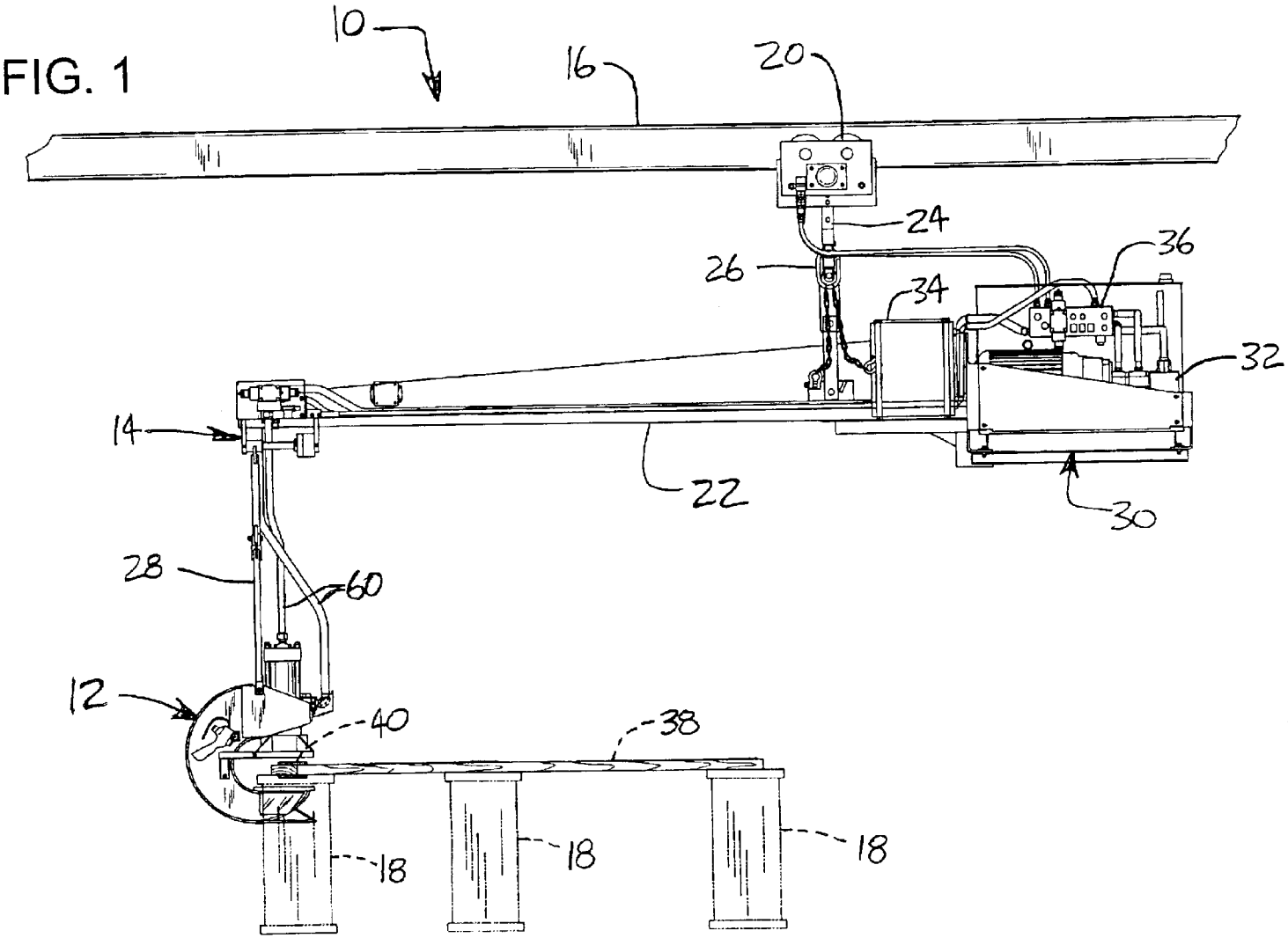
FIG. 1 is an elevation of a press system and support pedestals holding a truss.

Referring to the drawings, FIG. 1 shows a press system according to the present invention, generally indicated at 10, for assembling structures such as trusses. The apparatus 10 includes a press, indicated generally at 12, which is suspended by a suspension assembly 14 from an overhead rail 16 for movement between a series of conventional splice pedestals 18. The suspension assembly 14 includes a carriage assembly 20 movable along the rail, a pivotal boom 22 attached to the carriage by a hanger 24 and swivel 26, and a yoke 28 suspended from one end of the boom. The press is counterbalanced by a power and control assembly 30 including a hydraulic power unit 32, counterweight (not shown), electrical panel and control unit 34, and manifold 36 on the opposite end of the boom. The press 12, suspension assembly 14, and power and control assembly 30 are considered collectively to be a press system. Pedestals 18 hold structural members 38, such as pre-cut timbers, which are to be secured together by the press at their intersections with connector plates 40. Although the press 12 is shown operating on wooden components (i.e., pre-cut timbers), the press may be used to press connector plates into components made of other materials.

Figure 3:
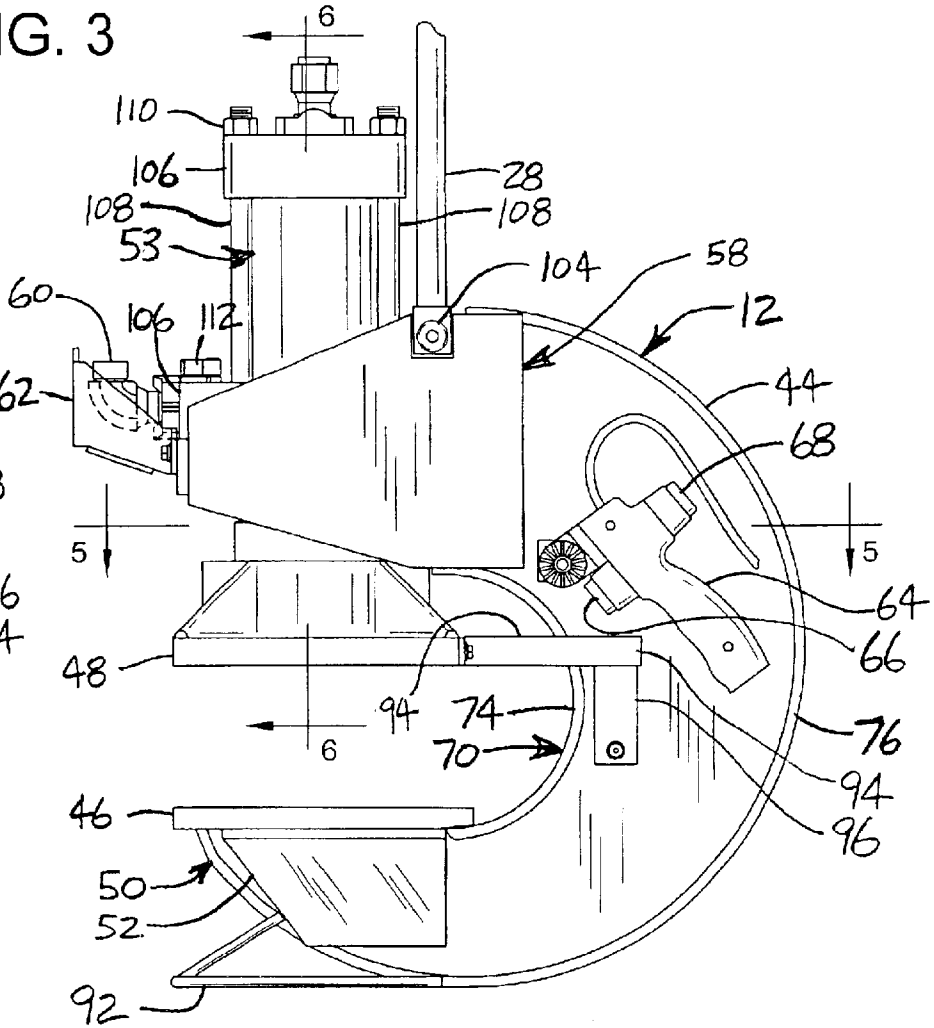
FIGS. 2 and 3 are front and side elevations, respectively, of a press of the press system.
Figure 2:
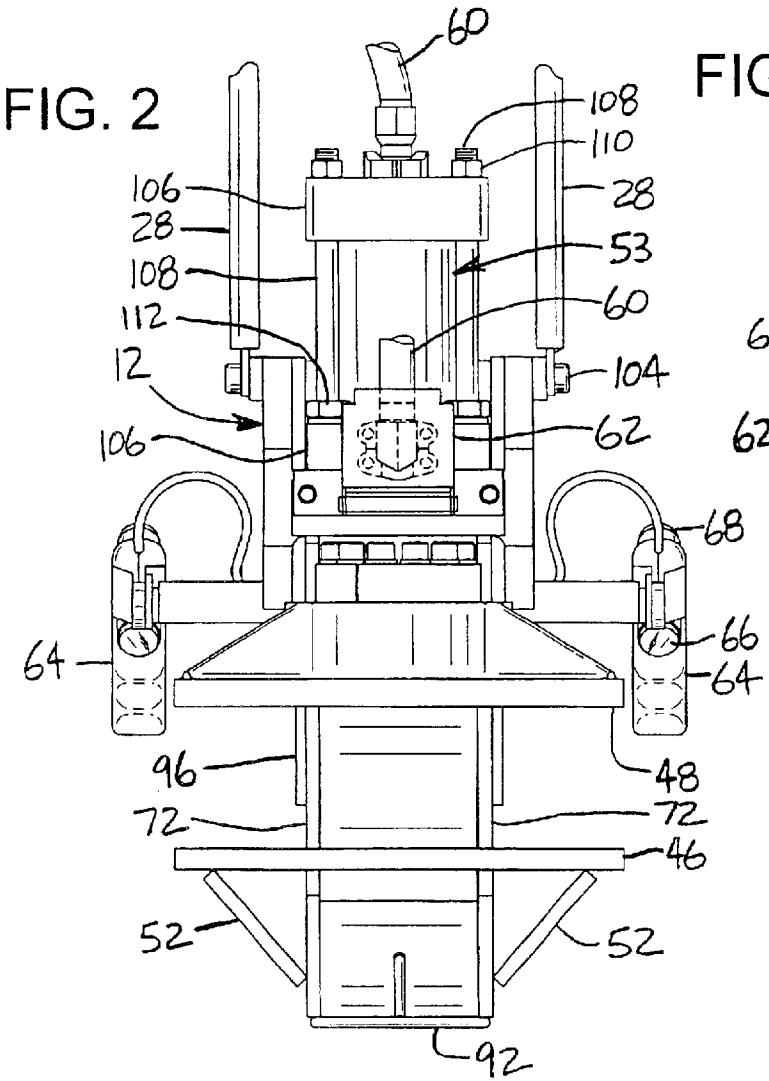
Figure 4:
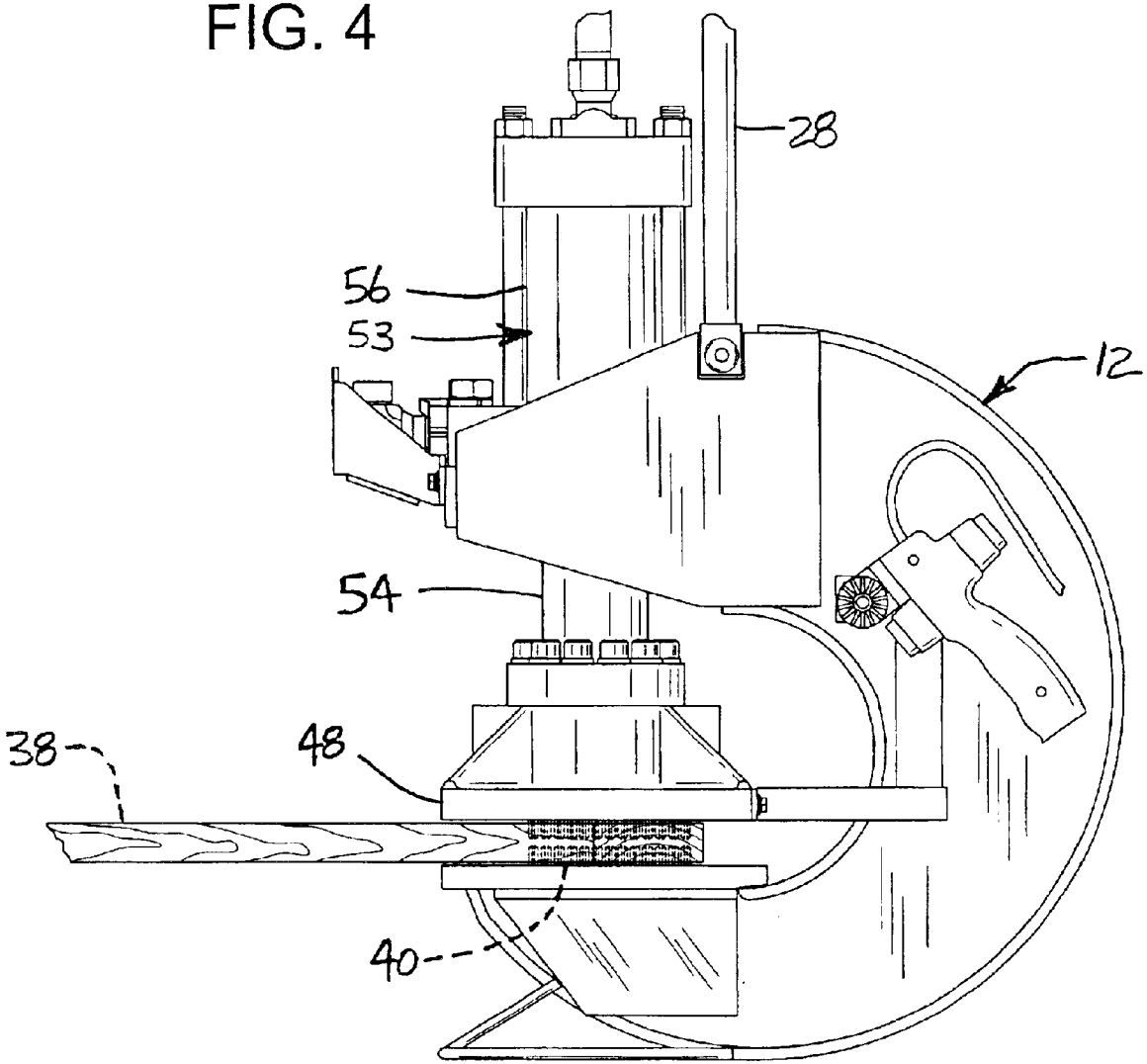
FIG. 4 is similar to FIG. 3 but shows the press pressing connector plates into opposing surfaces of structural members which are to be secured together.

Referring to FIGS. 2 and 3, the press 12 comprises a frame 44 which supports first and second platens 46, 48 for relative movement toward one another to press the connector plates into the timbers, and away from one another so that the platens may clear the timbers and connector plates so that the press may be moved to another position. In the illustrated embodiment, the first platen 46 is a lower platen and is fixedly attached to a first portion 50 of the frame 44, such as by welding, and strengthened by two lateral support plates 52. The second platen 48 is an upper platen movable via a hydraulic powered cylinder 53 (broadly, "actuator") having a tubular body 56 (FIG. 4) holding a movable piston and rod assembly 54. The cylinder body 56, and hence the upper platen 48, are mounted on an actuator mount 58, constituting a second portion of the frame 44. The platens 46, 48 are generally rectangular in planform shape and of sufficient size for engaging an entire extent of a connector plate 40, with an exemplary size of each platen being 10×16 inches. An exemplary diameter of the bore of cylinder body 56 is six inches. However, the platens and cylinder may have other shapes and sizes (not shown) FIG. 4 shows the second platen 48 moved downwardly such that the platens press the connector plates into opposing surfaces of the structural members 38.

The cylinder 53 is interconnected to the hydraulic power unit 32 by conventional hydraulic fluid lines 60 for providing hydraulic fluid under pressure to forcibly move the second platen 48 toward and away from the first platen 46. A protective guard 62 is provided over the frontmost hydraulic fluid line 60 and its attachment to the cylinder 53. Conventional pistol grip handles 64 are provided on opposite sides of the frame 44 so as to enable an operator readily to control the movement and operation of the press. Push button electrical switches 66 are mounted on the handles 64 for movement of the carriage 20 along the overhead rail 16. Additional push button electrical switches 68 are provided on the handles for controlling operation of the platens of the press 12. Other arrangements, shapes, number and orientations of the platens, including configurations where all platens are movable, and other power sources (i.e., non-hydraulic) do not depart from the scope of this invention.

Figure 9:
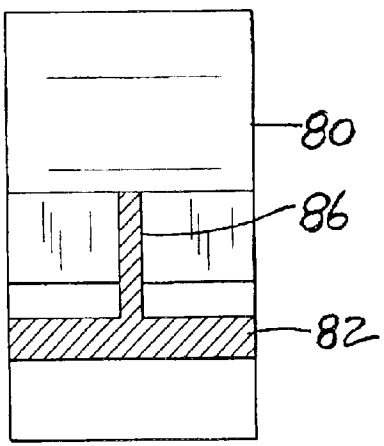
FIG. 9 is a section on line 9—9 of FIG. 8.
Figure 8:
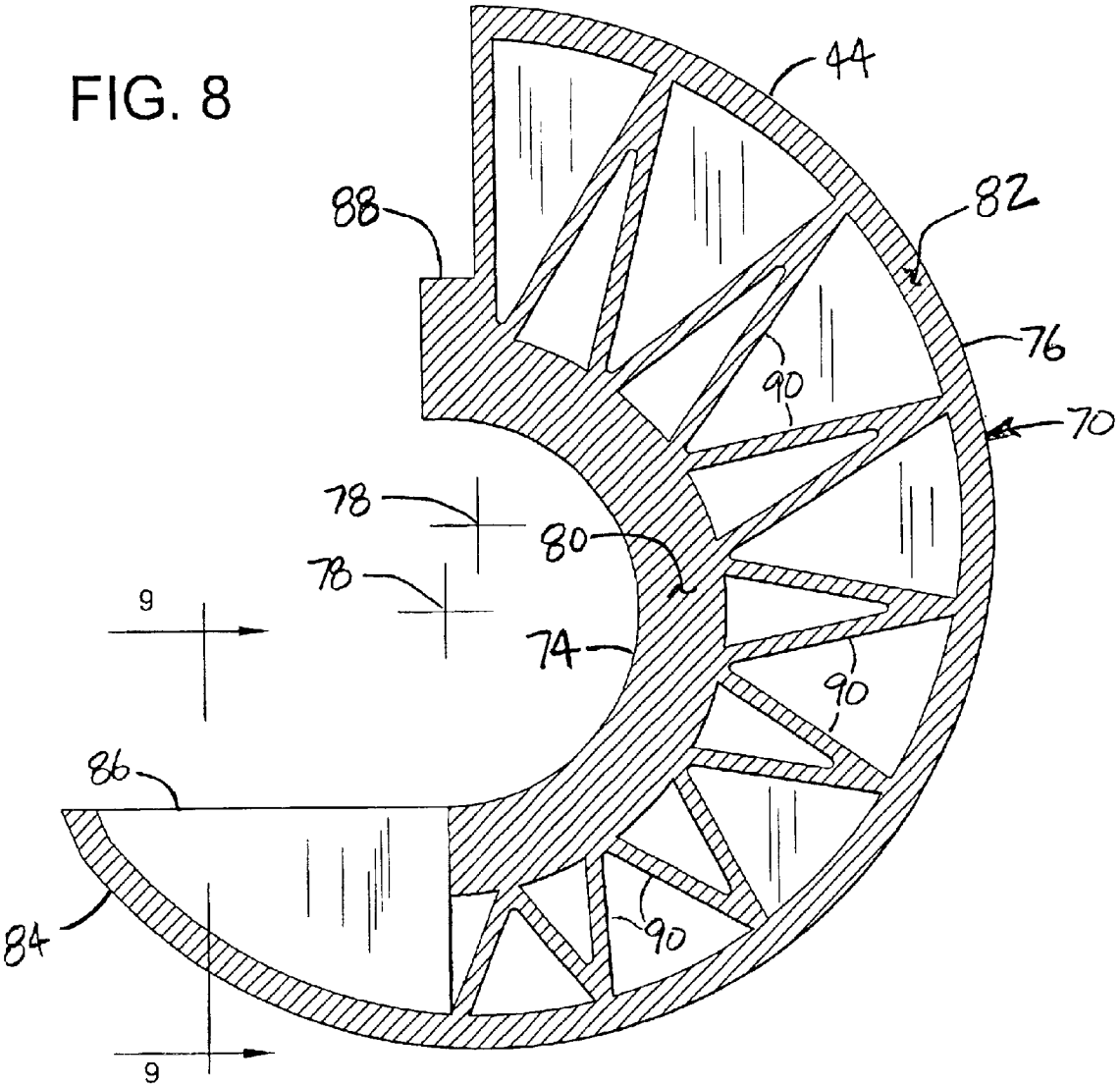
FIG. 8 is a vertical section of a frame of the press.

The frame 44 includes a central (or third) portion 70, shown in section in FIG. 8, which has a generally C-shape and a uniform width. The central portion 70 is laterally bounded by two side plates 72 (FIG. 2) attached to the central portion. Referring to FIGS. 8 and 9, the frame 44 is adapted to inhibit fatigue damage. The frame has an inner peripheral load carrying surface 74 and an outer peripheral load carrying surface 76 which each have a shape that is smooth and free from discontinuity (i.e., generally no sharp or distinct localized bends in slope). Preferably the shapes generally define arcs, and more preferably segments of circles, such as semicircles, having noncoincident centers 78. The arcs each have a rate of change of slope which ideally is close to a constant value along the extent of the respective load carrying surface 74, 76. That avoids discontinuity and stress concentration. Moreover, the central portion 70 of the frame and its arcs are free of any straight sections. Accordingly, there are no tight bends defining corners in which stress concentrations occur. Forces applied to the frame 44 while the platens 46, 48 are pressing the connector plates are transmitted in loadpaths through the inner load carrying surface 74 and outer load carrying surface 76 which do not produce appreciable concentrations in stress beyond a nominal stress. Other smooth but non-circular shapes do not depart from the scope of this invention, nor do frames with only one peripheral load carrying surface having a shape free from discontinuity.

The frame 44 has an inner structural rim 80 (FIG. 8) having a generally uniform thickness and which defines the inner peripheral load carrying surface 74. Similarly, an outer structural rim 82 has a generally uniform thickness (less than the inner rim) and defines the outer peripheral load carrying surface 76. The inner rim 80 is generally semicircular, but the outer rim 82 extends to a greater angular extent on the lower side of the frame 44 such that the outer rim forms a chin 84 for supporting the second platen 48. The centers 78 are noncoincident, with an upper region of the frame 44 being generally thicker than the lower region, because stress levels are generally greater in the upper. A central web 86 (FIG. 9) is positioned between the inner and outer rims 80, 82 at the chin 84 and is oriented generally vertically. A shoulder 88 is provided for engagement by the actuator mount 58, as discussed below.

Internal ribs 90 (collectively, "ribbing") span and connect the inner and outer rims 80, 82 for strengthening the frame 44 and distributing load. As seen in FIG. 8, the ribs 90 are arranged in a triangular web pattern between the inner and outer rims. In this way, the frame itself becomes a truss for resisting applied loads, with the ribs 90 not only rigidifying the inner and outer rims 80, 82 but transferring loads between them. The ribs facilitate a more efficient distribution of load between the inner and outer rims. In use, the frame 44 of this invention has permitted application of double the pressing load (from 25 tons to 50 tons) without increasing size or weight of the frame and without formation of fatigue cracks after repeated use. The ribs 90 have thicknesses which are large enough to transmit loads and minimize sharp edges at triangle corner radii, while small enough to avoid substantial weight penalty. Preferably, all the ribs 90 have a uniform thickness, such as ⅜ inch, although the thicknesses may vary depending on design loads. Further, the number and arrangement of ribs which extend between the inner and outer rims may vary without departing from the scope of this invention.

The inner rim 80, outer rim 82, ribs 90, and central web 86 are preferably formed as one piece (comprising the central portion 70 of the frame), such as a one piece casting. That minimizes manufacturing cost and improves structural integrity. The frame 44 is formed of a suitable strong material, such as ASTM A148 steel. Frames which are formed with more than one piece or from other materials do not depart from the scope of this invention.

The frame 44 includes a foot 92 for supporting the frame in an upright position when it is lowered to a floor. Two guide bars 94 (FIGS. 3 and 5) extend from the second platen 48 on opposite sides of the frame for preventing rotation of the cylinder 54 and second platen relative to the frame. The guide bars 94 are mounted in a cantilever arrangement with an end portion of each guide bar engaging a slide pad 96 which is fixedly mounted on the frame 44. As the second platen 48 moves up and down relative to the frame, the end portion of each guide bar 94 also moves and slides along the respective pad 96. The engagement prevents rotation of the cylinder and platen.

Figure 10:
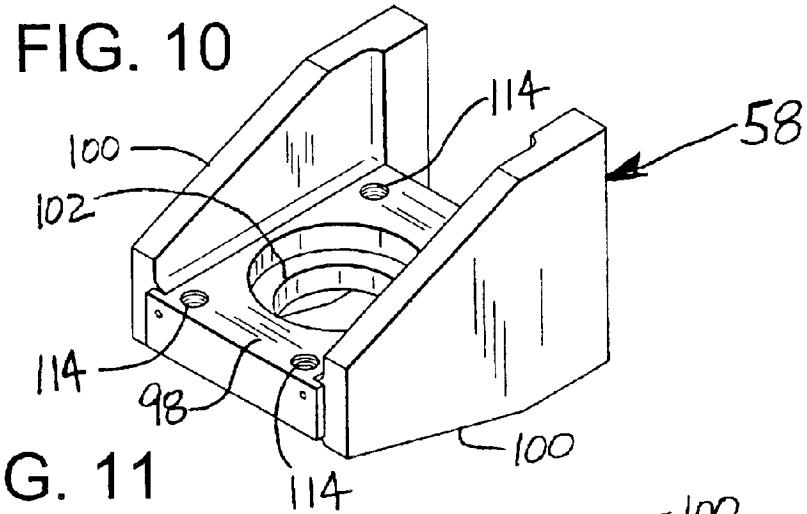
FIG. 10 is a perspective of a cylinder mount of the apparatus.
Figure 11:
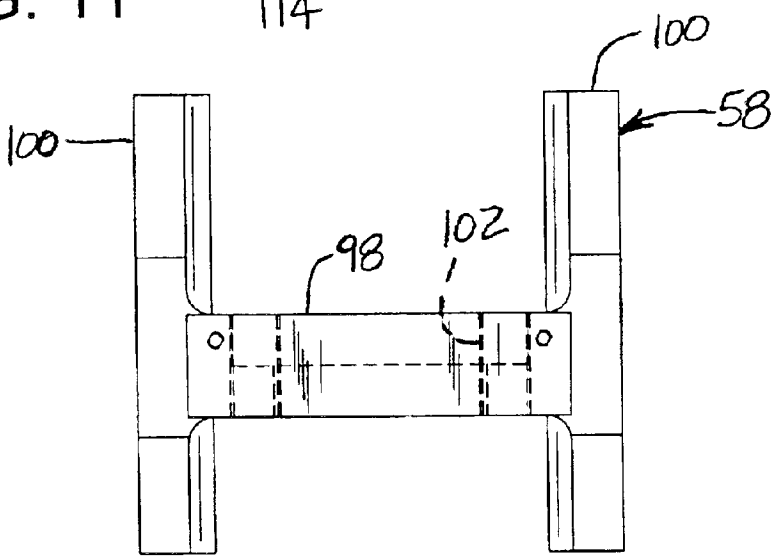
FIGS. 11 and 12 are front and right side elevations, respectively, of the cylinder mount of FIG. 10.
Figure 12:
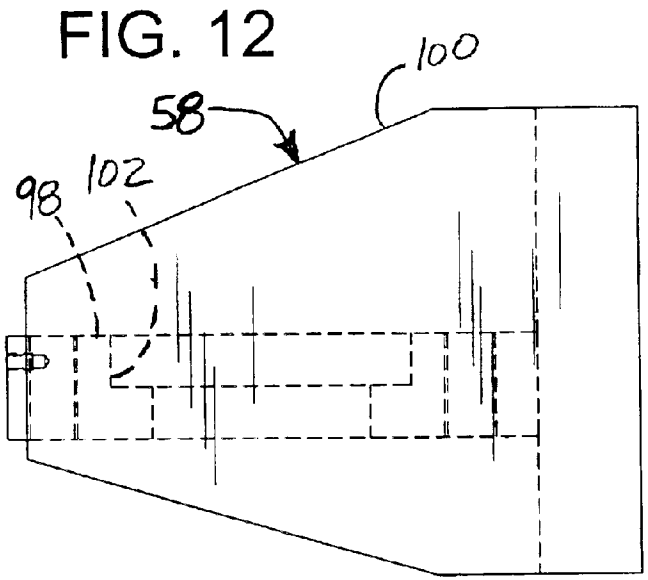
Figure 13:
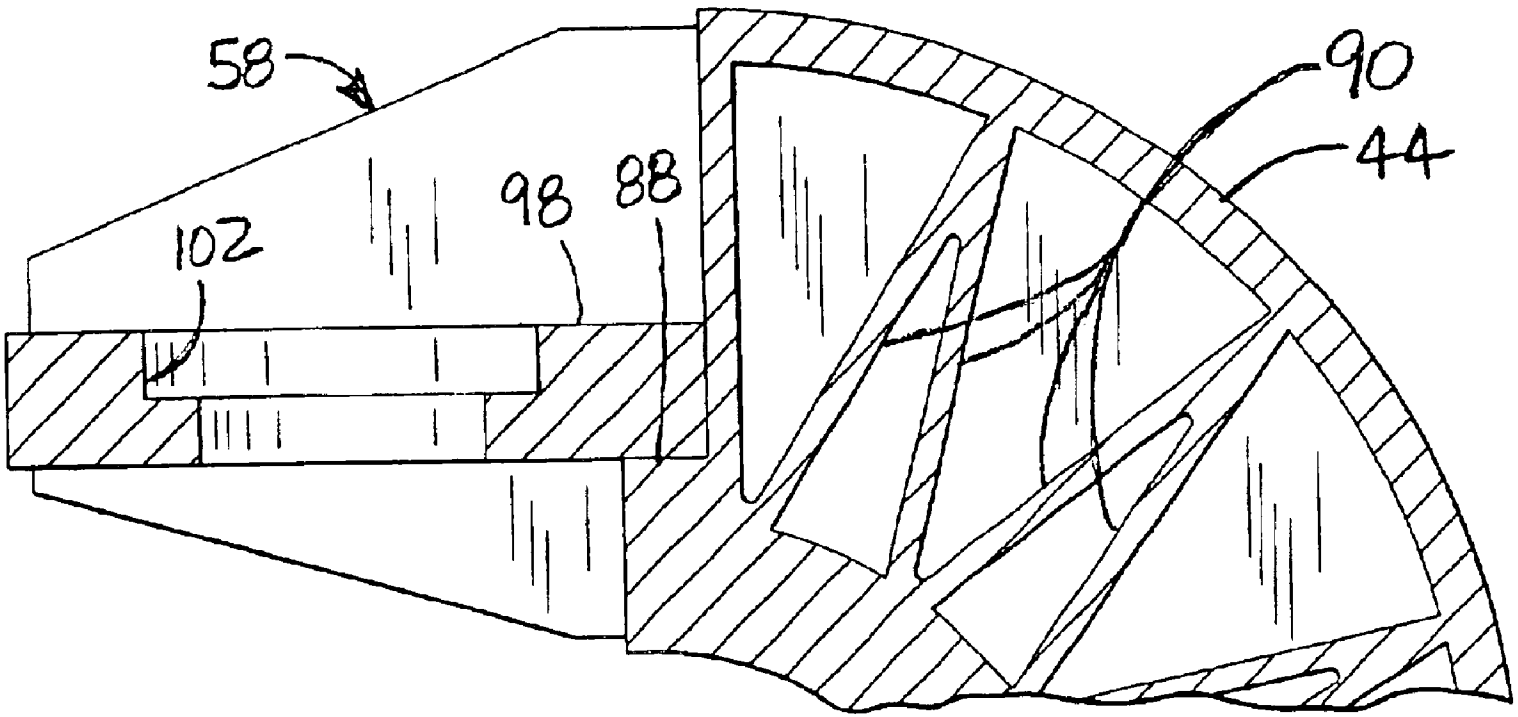
FIG. 13 is a fragmentary elevational section showing the engagement of the cylinder mount and the C-frame.

The actuator mount 58 is attached to the central portion 70 of the frame 44 and configured for mounting the cylinder body 56. Referring to FIGS. 10–12, the mount 58 includes a platform 98 and two sloping sidewalls 100 attached to the platform and forming lateral sides of the mount. The platform 98 has a counterbored hole 102 therein adapted for receiving the cylinder rod 54 and forming a seat for the cylinder body 56. The platform 98 is configured for stable engagement with the shoulder 88 of the frame, as seen in FIG. 13, and the sidewalls 100 are fixedly attached to the side plates 72 of the frame, as by welding. The press 12 is suspended by attaching the sidewalls 100 to the yoke 28 at pivots 104 (FIGS. 2 and 3) which are located at a position generally aligned with a center of gravity so that the frame is maintained at a desired orientation.

The mount 58 is configured such that the cylinder 53 and its body 56 are removably attachable for rapid repair and maintenance. Upper and lower cylinder blocks 106 (FIG. 2) are provided for holding the body 56 on the actuator mount 58. Four connecting rods 108 interconnect the upper and lower blocks 106. Each rod 108 is received through the upper block and is threaded on an upper end for receiving a cap nut 110. Each rod 108 is threaded on a lower end for being received in a threaded hole (not shown) on the lower block. Bolt fasteners 112 (FIG. 2) hold the assembled blocks 106 and body 56 to the mount 58. The fasteners 112 extend through the lower block 106 and are received in threaded holes 114 (FIG. 10) positioned on the platform 98. A differently sized cylinder 53 may be substituted for applying a larger or smaller load, or a malfunctioning cylinder may be replaced, by unfastening the blocks 106 from the mount, detaching the hydraulic lines 60, and installing a new body 56. There are no welds or fixed attachment which must be broken, and downtime is minimized. The cylinder and its tubular body are therefore "off the shelf" replaceable units. Other attachable/detachable mounting configurations of the cylinder do not depart from the scope of this invention.

Figure 7:
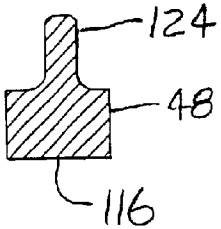
FIG. 7 is a section on line 7—7 of FIG. 5.
Figure 6:
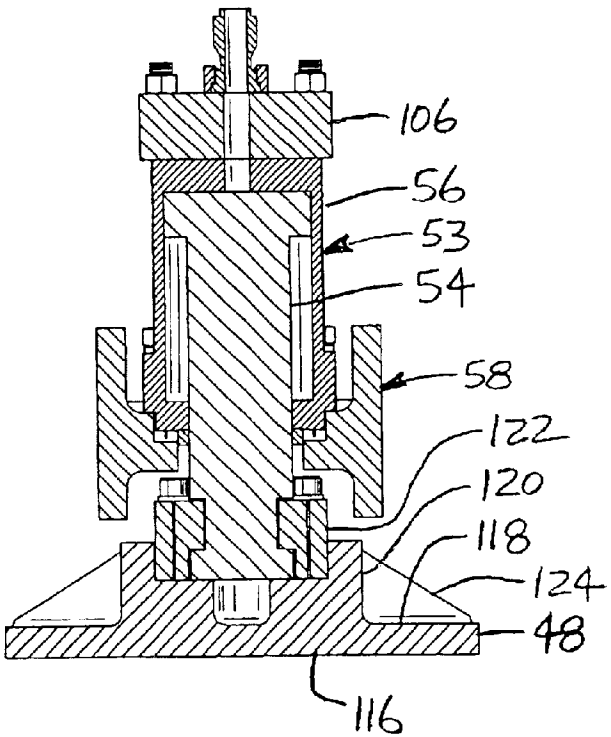
FIG. 6 is a section on line 6—6 of FIG. 3.
Figure 5:
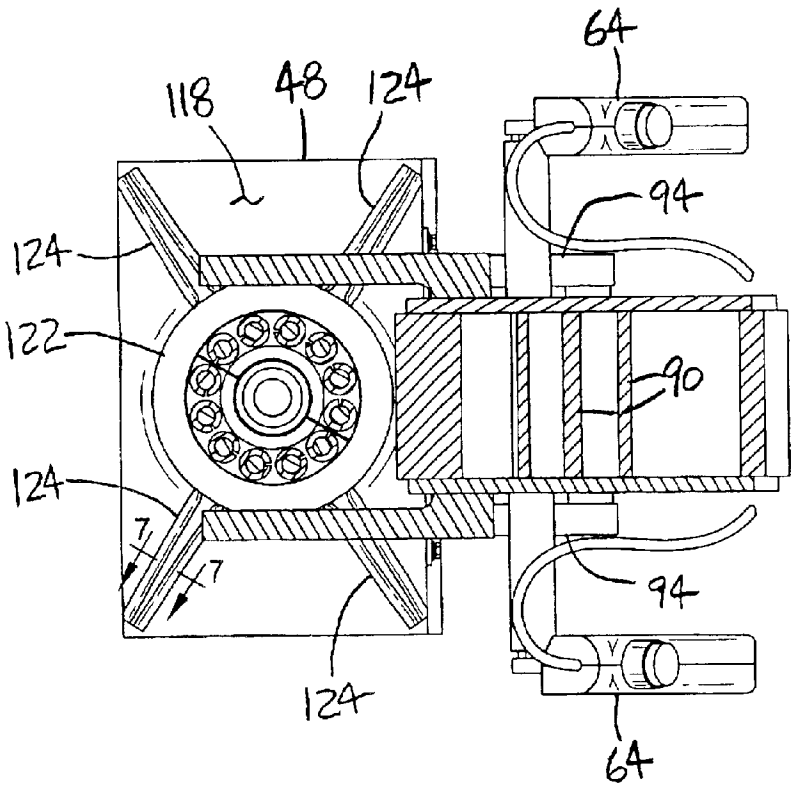
FIG. 5 is a section on line 5—5 of FIG. 3.

The second platen 48 is designed for strength for applying relatively greater forces, such as 50 tons. Referring to FIGS. 5–7, the platen 48 has a bottom side 116, comprising its front side, for engaging the connector plate 40 and a top side 118, comprising its back side. A boss 120 extends from the top side 118 for receiving the cylinder rod 54. A conventional coupler 122 having a collar and a ring of axial fasteners attach the cylinder rod 54 to the second platen 48. Four gussets 124 are in spaced arrangement on the top side 118 of the second platen, extending at an inclined angle between the boss 120 and the top side for providing added strength and stability. Each gusset 124 slopes in height from a maximum height near a top of the boss 120 to the surface of the top side 118. Preferably, the second platen 48, boss 120, and gussets 124 are formed in one piece. The gussets 124 inhibit deflections of the second platen 48 and do so without increasing thickness of the platen which would increase weight and cost. When the platen 48 inadvertently presses a non-flat object, such as due to operator error, the load is not distributed across the platen but rather is concentrated at one, usually eccentric location on the platen. The gussets 124 inhibit deflection and failure by transmitting the concentrated load to the boss 120 and more effectively distributing the load until the operator releases the press. Other configurations, such as a different size, number, or configuration of gusset(s), do not depart from the scope of this invention. Further, similar gussets could be included on the first platen 46.

Figure 14:
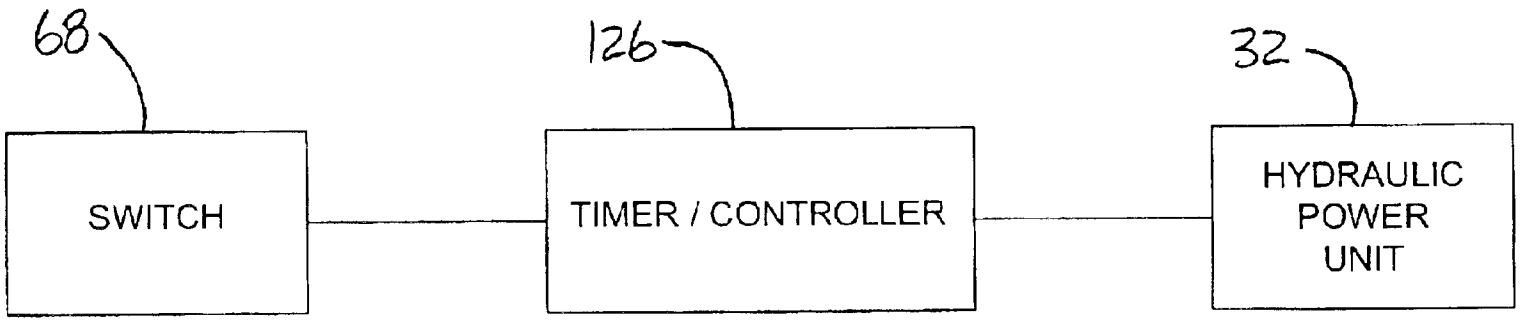
FIG. 14 is a schematic of a control system of the invention.

The apparatus of the present invention includes a timer and controller unit 126, indicated schematically in FIG. 14, for operational efficiency. The unit 126 is part of the control unit 34 shown in FIG. 1, and it is adapted to automatically hold the cylinder rod 54 at a preselected force for a preselected period of time. The timer and controller unit 126 is selectively adjustable for selecting the force and time period. Typically, the preselected force is a maximum force which is to be applied by the press 12 and the time period is sufficient for completely embedding the connector plates 40 in the structural members 38. The time period, also known as "dwell time" to those skilled in the art, is an automated hold at the selected maximum force to permit the fasteners on the connector plates 40 to more fully embed in pre-cut timbers. A typical period is 3 seconds. When the operator presses the push button electrical switches 68, the hydraulic power unit 32 is activated to move the cylinder rod 54 and second platen 48 and press the connector plates 40 into the structural members 38. When the applied force reaches the preselected or maximum force, as measured by conventional sensors (not shown), the power unit holds the force relatively constant for the preselected dwell time before beginning release. The automation of the timer permits a more exact and repeatable process which avoids delays of manual inspection/estimation and repetitive cycles of force application.

In view of the above, it will be seen that the several objects of the invention are achieved and other advantageous results obtained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A press for use in pressing connector plates into opposing surfaces of structural members which are to be secured together at one or more joints to form a structure, the press comprising:

first and second platens sized and shaped for engaging connector plates to press the connector plates into the structural members;

a frame including a first mounting portion mounting the first platen, a second mounting portion mounting the second platen and a third portion interconnecting the first and second mounting portions, the frame positioning the first and second platens in generally opposed relation for relative movement toward each other to press connector plates into the structural members and away from each other to clear the structural members and connector plates; and an actuator mounted on the frame for applying a force to at least one of the first and second platens to forcibly move said at least one platen;

the third portion of the frame being free of straight sections thereby to inhibit the concentration of stress in one location of the frame in operation of the press, and wherein the third portion of the frame has inner and outer load carrying surfaces, said inner load carrying surface extending along a first arc and said outer load carrying surface extending along a second arc, such that forces applied to the frame while the platens are pressing the connector plates are transmitted in load-paths through the inner or outer load carrying surfaces which are smooth and free from discontinuity to inhibit concentration of stress at any position along the load carrying surfaces and thereby strengthen the frame against fatigue damage.

2. A press as set forth in claim 1 wherein the inner load carrying surface extends along a segment of a circle.

3. A press as set forth in claim 2 wherein the outer load carrying surface extends along a segment of a circle.

4. A press as set forth in claim 3 wherein inner and outer load carrying surfaces each have a center of curvature, the centers of curvature being noncoincident.

5. A press as set forth in claim 1 wherein the frame comprises an inner rim including the inner load carrying surface, an outer rim including the outer load carrying surface, and ribbing spanning and connecting the inner and outer rims for strengthening the frame.

6. A press as set forth in claim 5 wherein the inner rim, outer rim, and ribbing are formed as one piece.

7. A press as set forth in claim 6 wherein the ribbing is arranged in triangular patterns between the inner and outer rims.

8. A press as set forth in claim 1 wherein the first platen is fixedly attached to the frame, and the second platen is movable relative to the frame.

9. A press as set forth in claim 8 wherein the actuator is adapted for moving the second platen, the actuator having a body which is removably attachable to the frame.

10. A press as set forth in claim 9 further comprising a platform attached to the frame and configured for mounting the actuator body.

11. A press as set forth in claim 10 wherein the second platen has a front side and a back side, and the apparatus further comprises a boss on the back side of the second platen for receiving the actuator, and at least one gusset extending between the boss and the back side of the second platen for strengthening the second platen.

12. A press as set forth in claim 11 wherein the second platen has four gussets in spaced arrangement on the back side.

13. A press as set forth in claim 8 further comprising a timer adapted for automatically holding the actuator at a preselected force for a preselected period of time.

14. A press as set forth in claim 1 in combination with a suspension assembly adapted to support the press from an overhead position.

15. A press and suspension assembly as set forth in claim 14 further in combination with a support capable of supporting the structural members and connector plates.

16. A press as set forth in claim 1 wherein the actuator is a hydraulic cylinder.

17. A press for use in pressing connector plates into opposing surfaces of structural members which are to be secured together at one or more joints to form a structure, the press comprising:

first and second platens sized and shaped for engaging connector plates to press the connector plates into the structural members;

a frame mounting the first and second platens in generally opposed relation for relative movement toward each other to press connector plates into the structural members and away from each other to clear the structural members and connector plates; and an actuator mounted on the frame for applying a force to at least one of the first and second platens to forcibly move said at least one platen;

the frame including a peripheral inner rim at least a portion of which extends along a curved arc, a peripheral outer rim at least a portion of which extends along a curved arc, and ribbing positioned in a region between the curved arc portions of the inner and outer rims, the ribbing spanning and connecting the inner rim to the outer rim;

the ribbing comprising multiple ribs which each extend between the inner rim and the outer rim for transferring loads between the inner and outer rims, the ribs being arranged in a pattern of adjacent triangles which extends continuously for substantially an entire extent of said region between the inner and outer rims, the ribs being arranged contiguously end-to-end such that each rib is capable of transferring load directly to at least one adjacent rib.

18. A press as set forth in claim 17 wherein the inner rim, outer rim, and ribbing are formed as one piece.

19. A press as set forth in claim 17 wherein the first platen is fixedly attached to the frame, and the second platen is movable relative to the frame.

20. A press as set forth in claim 19 wherein the actuator is adapted for moving the second platen, the actuator having a body which is removably attachable to the frame.

21. A press as set forth in claim 20 further comprising a platform attached to the frame and configured for mounting the actuator body.

22. A press as set forth in claim 21 wherein the second platen has a front side and a back side, and the apparatus further comprises a boss on the back side of the second platen for receiving the actuator, and at least one gusset extending between the boss and the back side of the second platen for strengthening the second platen.

23. A press as set forth in claim 22 wherein the second platen has four gussets in spaced arrangement on the back side.

24. A press as set forth in claim 17 further comprising a timer adapted for automatically holding the actuator at a preselected force for a preselected period of time.

25. A press as set forth in claim 17 wherein the frame includes a first portion mounting the first platen, a second portion mounting the second platen and a third portion interconnecting the first and second mounting portions, the third portion including an inner load carrying surface extending along a segment of a circle thereby to inhibit the concentration of stress in one location of the frame in operation of the press.

26. A press as set forth in claim 17 in combination with a suspension assembly adapted to support the press from an overhead position.

27. A press and suspension assembly as set forth in claim 26 further in combination with a support capable of supporting the structural members and connector plates.

28. A press as set forth in claim 17 wherein the actuator is a hydraulic cylinder.

29. A press as set forth in claim 17 wherein length of a rib adjacent one circumferential end of said region is greater than length of a rib adjacent an opposite circumferential end of said region.

30. A press for use in pressing connector plates into opposing surfaces of structural members which are to be secured together at one or more joints to form a structure, the press comprising:

first and second platens sized and shaped for engaging connector plates to press the connector plates into the structural members;

a frame mounting the first and second platens in generally opposed relation for relative movement toward each other to press connector plates into the structural members and away from each other to clear the structural members and connector plates;

an actuator mounted on the frame for applying a force to at least one of the first and second platens to forcibly move said at least one platen; and a timer control adapted for automatically holding the actuator at a preselected force for a preselected period of time and then to move said at least one of the first and second platens away from the other of said platens to release the force.

31. A press as set forth in claim 30 wherein the timer control is selectively adjustable for changing the preselected period of time.

32. A press as set forth in claim 30 wherein the frame comprises an inner rim, and outer rim and ribbing spanning and connecting the inner rim to the outer rim, and wherein the inner rim, outer rim, and ribbing are formed as one piece.

33. A press as set forth in claim 32 wherein the ribbing is arranged in triangular patterns between the inner and outer rims.

34. A press as set forth in claim 32 wherein the first platen is fixedly attached to the frame, and the second platen is movable relative to the frame.

35. A press as set forth in claim 34 wherein the actuator is adapted for moving the second platen, the actuator having a body which is removably attachable to the frame.

36. A press as set forth in claim 35 further comprising a platform attached to the frame and configured for mounting the actuator body.

37. A press as set forth in claim 36 wherein the second platen has a front side and a back side, and the apparatus further comprises a boss on the back side of the second platen for receiving the actuator, and at least one gusset extending between the boss and the back side of the second platen for strengthening the second platen.

38. A press as set forth in claim 37 wherein the second platen has four gussets in spaced arrangement on the back side.

39. A press as set forth in claim 30 wherein the frame includes a first portion mounting the first platen, a second portion mounting the second platen and a third portion interconnecting the first and second mounting portions, the third portion including an inner load carrying surface extending along a segment of a circle thereby to inhibit the concentration of stress in one location of the frame in operation of the press.

40. A press as set forth in claim 30 in combination with a suspension assembly adapted to support the press from an overhead position.

41. A press and suspension assembly as set forth in claim 40 further in combination with a support capable of supporting the structural members and connector plates.

42. A press as set forth in claim 30 wherein the actuator is a hydraulic cylinder.

43. A press for use in pressing connector plates into opposing surfaces of structural members which are to be secured together at one or more joints to form a structure, the press comprising:

first and second platens sized and shaped for engaging connector plates to press the connector plates into the structural members;

a frame mounting the first and second platens in generally opposed relation for relative movement toward each other to press connector plates into the structural members and away from each other to clear the structural members and connector plates; and an actuator mounted on the frame for applying a force to at least one of the first and second platens to forcibly move said at least one platen;

the frame including an inner load carrying surface extending along a segment of a first circle having a first center of curvature, an outer load carrying surface extending along a segment of a second circle having a second center of curvature, and wherein said first and second centers of curvature are noncoincident and the inner and outer load carrying surfaces are non-concentric.

* * * * *